US007601101B2

(12) United States Patent
Jackson et al.

(10) Patent No.: US 7,601,101 B2
(45) Date of Patent: Oct. 13, 2009

(54) EXERCISE APPARATUS

(75) Inventors: Michael Jackson, Las Vegas, NV (US); Robert Braden, Las Vegas, NV (US)

(73) Assignee: Powerbox Fitness, LLC, Las Vegas, NV (US)

( * ) Notice: Subject to any disclaimer, the term of this patent is extended or adjusted under 35 U.S.C. 154(b) by 625 days.

(21) Appl. No.: 11/150,490

(22) Filed: Jun. 10, 2005

(65) Prior Publication Data

US 2006/0052220 A1 Mar. 9, 2006

Related U.S. Application Data

(63) Continuation-in-part of application No. 10/412,654, filed on Apr. 11, 2003, now Pat. No. 6,908,417, which is a continuation of application No. 09/492,504, filed on Jan. 27, 2000, now Pat. No. 6,558,301.

(51) Int. Cl.
*A63B 22/04* (2006.01)

(52) U.S. Cl. ..... 482/52; 482/142

(58) Field of Classification Search ..... 482/52, 482/121, 122, 123, 126, 129, 130, 140, 142, 482/148, 910; 601/23, 24, 33, 34
See application file for complete search history.

(56) References Cited

U.S. PATENT DOCUMENTS

| | | | | |
|---|---|---|---|---|
| 3,664,666 | A | | 5/1972 | Lloyd |
| 3,893,667 | A | | 7/1975 | Snyder, Jr. et al. |
| 4,198,044 | A | | 4/1980 | Holappa |
| 4,913,423 | A | | 4/1990 | Farran et al. |
| 5,050,861 | A | | 9/1991 | Thomas et al. |
| 5,072,934 | A | | 12/1991 | Blanes |
| 5,090,694 | A | | 2/1992 | Pauls et al. |
| 5,118,095 | A | | 6/1992 | Flor |
| D330,057 | S | | 10/1992 | Saunders et al. |
| D330,234 | S | | 10/1992 | Saunders et al. |
| 5,154,678 | A | | 10/1992 | Adamczyk et al. |
| 5,184,987 | A | | 2/1993 | Wilkinson |
| D337,362 | S | | 7/1993 | Goldstein et al. |
| 5,232,426 | A | | 8/1993 | Van Straaten |
| D339,179 | S | | 9/1993 | Wilkinson |
| 5,261,864 | A | | 11/1993 | Fitzpatrick |
| 5,277,675 | A | | 1/1994 | Shifferaw |
| 5,290,210 | A | | 3/1994 | Hand et al. |
| 5,320,591 | A | | 6/1994 | Harmon et al. |
| 5,354,247 | A | | 10/1994 | Wilkinson |
| D353,419 | S | | 12/1994 | Sprague |
| D353,636 | S | | 12/1994 | LeRoux |
| 5,421,800 | A | | 6/1995 | Mullen |
| 5,441,466 | A | | 8/1995 | Piaget et al. |
| 5,505,681 | A | | 4/1996 | Bruggemann |
| 5,512,026 | A | | 4/1996 | Wilkinson |
| 5,529,562 | A | * | 6/1996 | Glaser ..... 482/146 |
| 5,575,742 | A | | 11/1996 | Wu |
| 5,584,779 | A | | 12/1996 | Knecht et al. |
| 5,591,105 | A | | 1/1997 | Dalebout et al. |
| 5,593,370 | A | | 1/1997 | Meldeau |

(Continued)

*Primary Examiner*—Loan H Thanh
*Assistant Examiner*—Tam Nguyen
(74) *Attorney, Agent, or Firm*—Weide & Miller, Ltd.

(57) ABSTRACT

An exercise apparatus has an exercise platform and an exercise device support structure. The exercise platform has a base and a lid, the platform defining an interior space accessible by moving the lid from a closed to an open position with respect to the base. The exercise device support structure is a tower having a plurality of exercise device attachment points. The platform is configured to store the tower when not in use, and support the tower in a vertical position when in use. Exercise devices, such as resistive elements, may be connected to the tower and/or the platform at various points of connection for performing a variety of exercises.

8 Claims, 6 Drawing Sheets

U.S. PATENT DOCUMENTS 5,599,258 A 2/1997 Stone et al.
5,645,512 A 7/1997 Yu
5,658,227 A 8/1997 Stearns
5,669,864 A 9/1997 Brister
5,683,331 A 11/1997 Dalebout
5,697,870 A 12/1997 Osborn
5,711,745 A 1/1998 Yang
5,713,821 A 2/1998 Nissen
5,718,656 A 2/1998 Byrd et al.
5,759,137 A * 6/1998 Huang ..... 482/72
5,810,697 A 9/1998 Joiner
5,813,947 A 9/1998 Densmore
5,830,111 A 11/1998 Johnston
5,842,955 A 12/1998 Wilkinson
5,860,894 A 1/1999 Dalebout et al.
5,860,895 A 1/1999 Lee
5,860,898 A 1/1999 Ellis
5,865,713 A 2/1999 Hsu
5,888,175 A 3/1999 Chang
5,895,342 A 4/1999 Solland
5,906,566 A * 5/1999 Whitcomb ..... 482/130
5,967,955 A 10/1999 Westfall et al.
6,245,001 B1 6/2001 Siaperas
6,475,127 B1 * 11/2002 Koenig ..... 482/104
6,558,301 B1 5/2003 Jackson
6,634,998 B2 * 10/2003 Siaperas ..... 482/142
2006/0003877 A1 * 1/2006 Harmon ..... 482/142

* cited by examiner 20
54
56
58
26
50
48
76
76
104
110
106
108
110
30
88
86
92
96
94
99
28
90
98
102
100
36
80
74
42
74
22
52
46
44
72
34
72
38
30
78
86
88
102
100
98
68
52
40
70
24
94
96
28
92
82
84
32
82
84
32

EXERCISE APPARATUS

RELATED APPLICATION DATA

This application is a continuation-in-part of U.S. application Ser. No. 10/412,654 filed Apr. 11, 2003, now U.S. Pat. No. 6,908,417, which is a continuation of U.S. patent application Ser. No. 09/492,504, filed Jan. 27, 2000, now U.S. Pat. No. 6,558,301.

FIELD OF THE INVENTION

The present invention relates to exercise equipment.

BACKGROUND OF THE INVENTION

In recent years, the number of individuals who have undertaken exercise regimens has grown tremendously. Each person has their own desires when it comes to when and where to exercise, and the type and number of exercises in which they wish to engage. Gyms provide large numbers of individuals with a wide range of exercise devices. Some people, however, wish to exercise at home or the office, by personal preference or constraints such as time or location. Individuals may have a limited budget and space for exercise equipment at home. As described below, current exercise equipment does not meet the differing goals and preferences of users.

Currently, a large variety of exercise equipment is available. This equipment ranges from simple steps, mats and free weights, to large and complex machinery that may be computer controlled, such as treadmills, rowing and stepping machines. Most individuals are limited in the number and type of exercise devices they may own, generally as a result of the cost of such equipment and the space necessary to store and use the equipment. Even gyms must be conscious of the space required by each piece of equipment or the number of devices which the gym may provide to its users may be unduly limiting. Thus, it is a desire to provide an exercise apparatus which may be conveniently stored and which is affordable to the home/office user.

Individuals commonly employ an exercise regimen where they work out at home or the gym one or more times per week. These individuals generally find it desirable to maintain their regimen when traveling, such as when on a business trip or vacation. Further, as noted above, some individuals do not wish to work out in a gym on all occasions or ever, but prefer to work out at home or work. For these reasons, it is desirable to provide exercise equipment which is portable and easy to store.

In addition to the foregoing, it is important to note that most individuals wish to engage in multiple exercises. For example, large numbers of individuals enjoy "step" exercises. These exercises involve stepping on and off a raised platform. These exercises are known for their cardiovascular benefits and work-out of the legs. In addition, the same individuals may wish to engage in strength and flexibility training involving other portions of the body, such as the arms, chest and shoulders. For example, bicep curls, rowing, overhead presses and similar exercises are all well known for exercising various specific portions of the body.

Present exercise equipment is deficient in addressing the above-stated problems and preferences. For example, large multi-station weight machines provide a user with the opportunity to perform a large number of exercises. On the other hand, these machines are not transportable, and are generally large and expensive. Simple "steps" are available (including those which maybe raised and lowered). These devices are easy to transport and relatively inexpensive, but afford the user very few exercises.

As a result of the above-stated problems and desires, there is a need for an exercise device which is both compact and portable. In addition, however, it is desirable for the device to permit a wide range of exercises.

SUMMARY OF THE INVENTION

The present invention comprises an exercise apparatus and one or more methods of using the apparatus, including methods of exercising with the apparatus.

In one or more embodiments, the exercise apparatus comprises an exercise platform comprising a base and a lid, the platform defining an interior space accessible by moving the lid from a closed to an open position with respect to the base, at least one handle associated with the platform for use by a user in moving the exercise apparatus, at least one wheel movably mounted to the base and permitting the platform to be rolled along a surface, at least one riser for use in supporting the platform upon a surface to increase a height thereof and sized to fit within the interior space when not in use, at least one resistive element for selective attachment to the platform for use in an exercise by a user, at least one mount associated with the platform to which the at least one resistive element may be attached, and at least one hand/foot peg for use with the platform.

In one or more embodiments, the mounts comprise aligned slots in the walls and lid and a pin extending across the portion of the slot in the wall. The resistive elements may comprise elastic elements having a hook at one end for coupling to the pin of a mount.

In one or more embodiments, the lid is hingedly mounted to the platform. One or more latches are provided for maintaining the lid in a closed position when a user is exercising.

One or more embodiments of the invention comprise a method of using the exercise apparatus. These methods include methods of transporting and arranging the apparatus for use.

One or more embodiments of the invention comprise methods of exercising using the apparatus. These methods include using the apparatus as an exercise platform/step and using the hand/foot pegs and resistive element(s) coupled to the platform in a variety of exercises.

Another aspect of the invention is an exercise device support or attachment structure. The structure includes a number of attachment points for exercise devices such as resistive elements. In one embodiment, the structure comprises a tower having a pair of spaced supports and a number of cross-members extending between the supports. The cross-members define exercise device attachment points. In one embodiment, those points comprise apertures or openings in the cross-members and pins which span those openings.

In one embodiment, the exercise platform supports the exercise device support. The exercise platform includes a mount having an opening for accepting the exercise device support or tower. Preferably, the tower can be stored in the platform or passed through the opening in the mount so that it is supported in a generally vertical position for use. In one embodiment, the mount is located at the top of the platform at one end, and cooperates with a lid to enclose the platform.

A user may attach a variety of exercise devices, such as resistive elements, to the exercise device support or tower. This allows the user to perform a much wider range of exercises.

Further objects, features, and advantages of the present invention over the prior art will become apparent from the detailed description of the drawings which follows, when considered with the attached figures.

DETAILED DESCRIPTION OF THE INVENTION

The present invention is an exercise apparatus. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
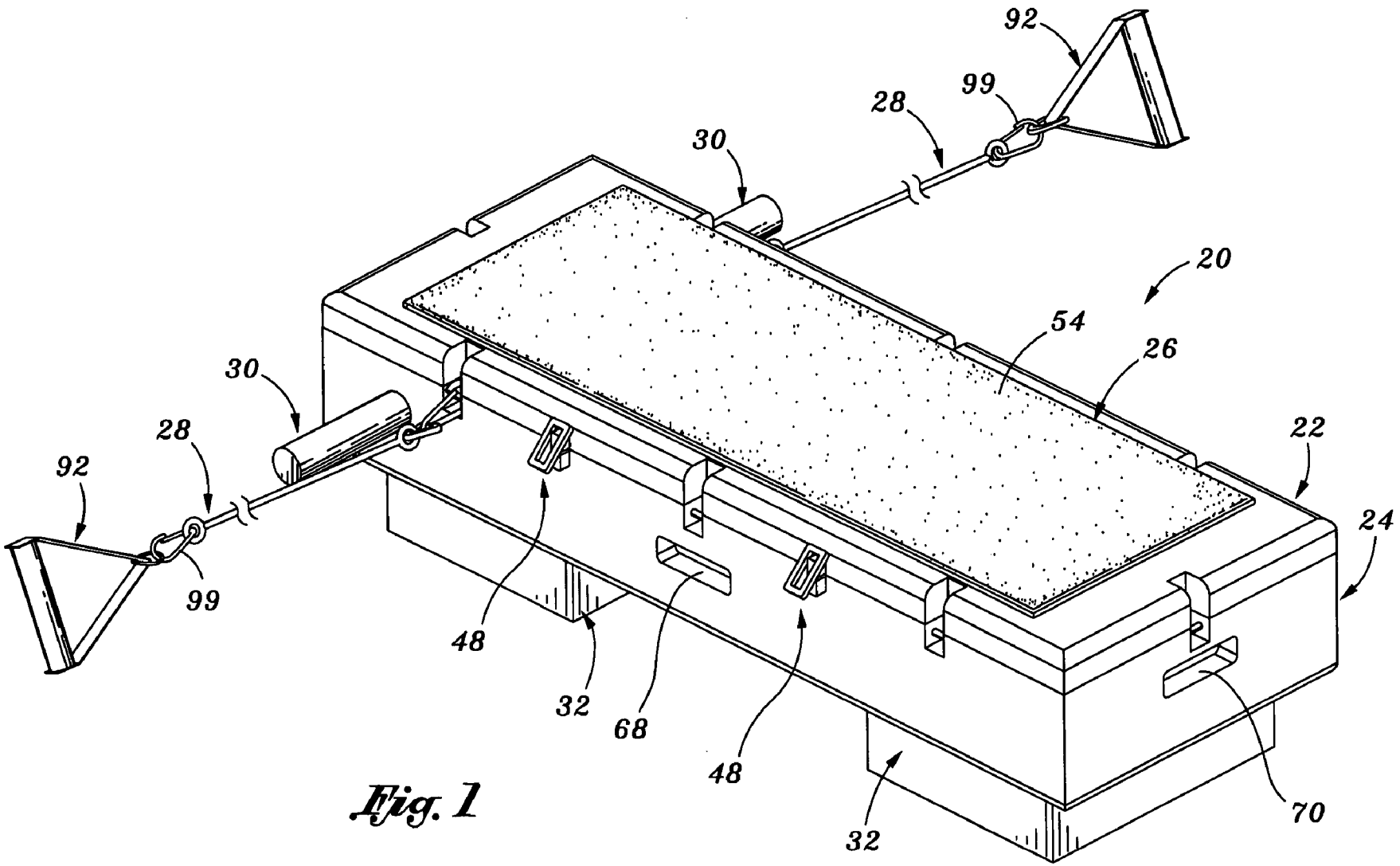
FIG. 1 is a top perspective view of an embodiment of the exercise apparatus in accordance with the present invention.

Referring to FIG. 1, an exercise apparatus 20 in accordance with one embodiment of the present invention will be described generally. As illustrated, the exercise apparatus 20 comprises an exercise platform 22. The platform 22 generally has the form of a box having a base 24 and a lid 26, and defines an open interior (see FIG. 3). The exercise platform 22 is arranged to permit a wide range of exercises both alone and with a variety of accessories. As illustrated, such accessories may include one or more resistive elements 28, one or more hand/foot pegs 30, and one or more risers 32.

Figure 2:
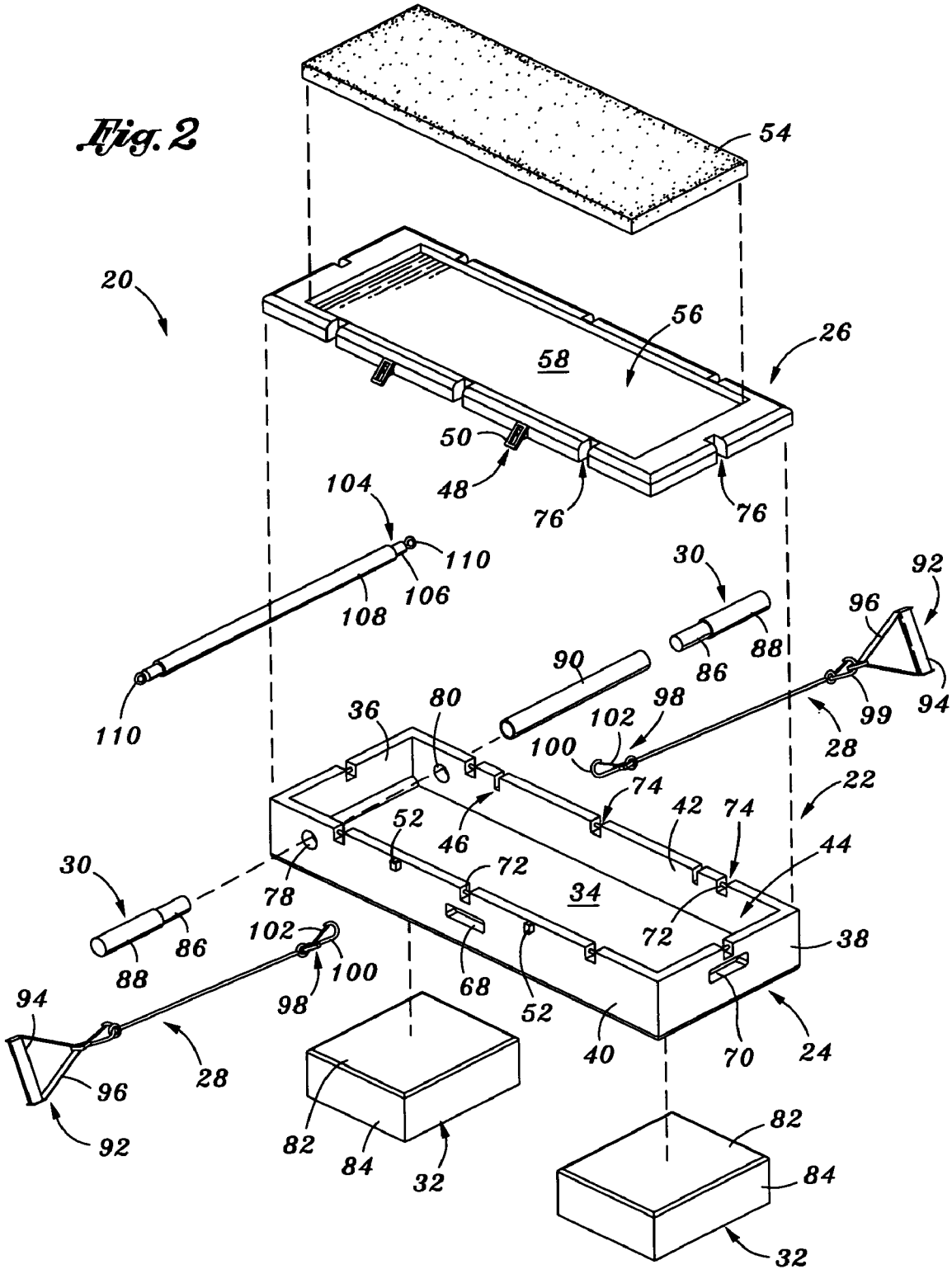
FIG. 2 is an exploded view of the exercise apparatus illustrated in FIG. 1.

The invention will now be described in more detail with reference to FIG. 2. As illustrated therein, the base 24 is generally rectangular in shape. The base 24 has a generally flat bottom surface 34. First, second, third and fourth walls 36,38,40,42 extend upwardly from the bottom surface 34. In the arrangement where the base 24 is generally rectangular in shape, one pair of opposing walls or ends (as illustrated, the first and second walls 36,38) are shorter than the other pair of opposing walls or sides (as illustrated, the third and fourth walls 40,42). In one or more embodiments, the platform 22 is about 40 inches long from end to end (i.e. wall 36 to wall 38) and about 15 inches wide from side to side (i.e. wall 40 to wall 42), and about 4 inches deep as measured from the top of the walls to the top or inside of the bottom surface 34. Of course, the size and shape of the platform 22 may vary from that described.

The lid 26 is arranged to mate with the walls 36,38,40,42 and generally cooperate with the base 24 to form an interior space 44. As illustrated, the lid 26 has the same general shape as the base 24, in this embodiment, rectangular.

The base 24 and lid 26 may be constructed from a wide variety of materials, such as plastic or wood. It will be appreciated that while the walls 36,38,40,42 are described independently for reference, the walls may comprise a single structural element, such as when the base 24 is molded.

Figure 4:
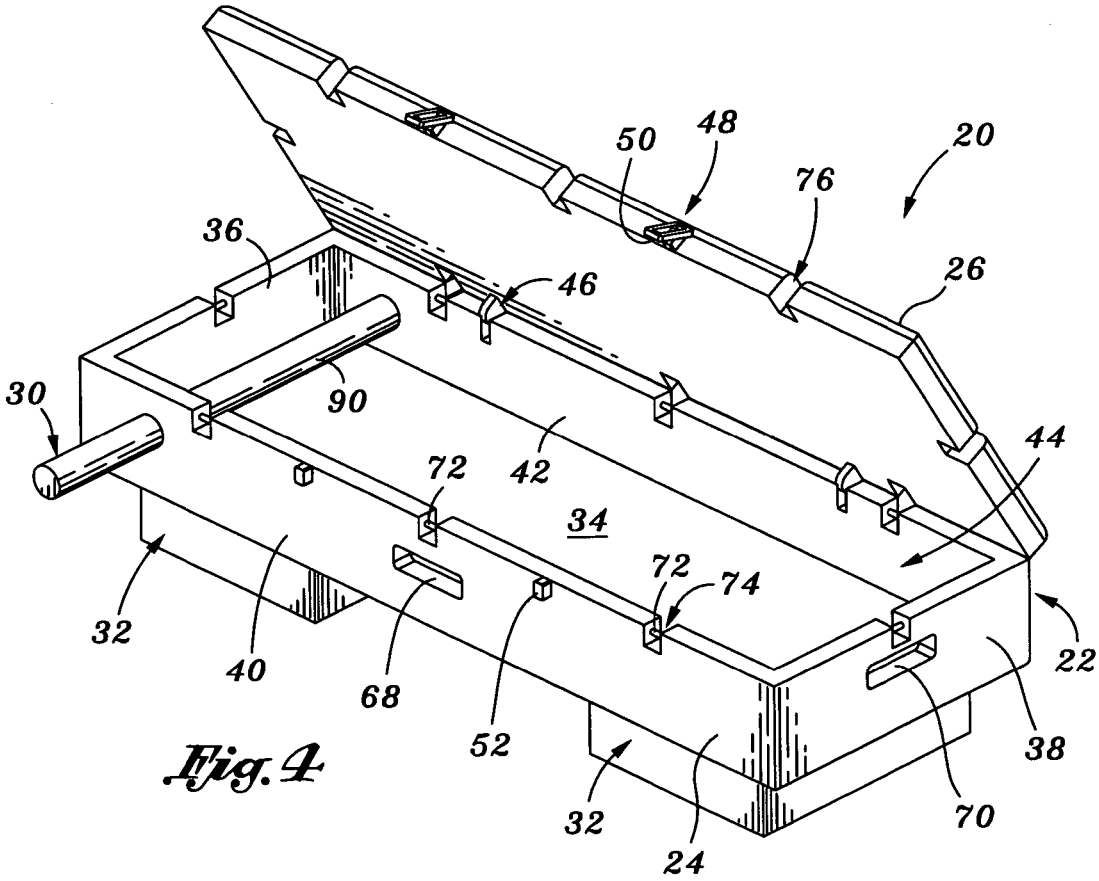
FIG. 4 is a bottom perspective view the exercise apparatus illustrated in FIG. 1.

In one or more embodiments, means are provided for selectively moving the lid 26 with respect to the base 24 so as to open or close the platform 22 and provide access to the interior space 44. Preferably, this means comprises a pair of hinges 46 (see also FIG. 4). Each hinge 46 is attached to the lid 26 and the base 24. As described in more detail below, the hinges 46 permit rotation of the lid 26 about an axis extending parallel to the fourth wall 42 of the base 24. In a first open or raised position of the lid 26, access is permitted to the interior 44 of the platform 22. In a second closed or lowered position of the lid 26, the interior space 44 is enclosed. As illustrated, the hinges 46 are spaced apart along the fourth wall 42.

Preferably, means are provided for, at one or more times, retaining the lid 26 in its second, closed or lowered position. In one or more embodiments, this means comprises a pair of latches 48. Each latch 48 comprises a moveable catch 50 connected to the lid 26 and a post 52 connected to or extending from the base 24.

Those of skill in the art will appreciate that a variety of other means may be provided for associating the lid 26 with the base 24. For example, the lid 26 may be connected to the base 24 by providing a rod connected to the lid which engages one or more sleeves, permitting rotation of the rod with respect to the sleeves. If constructed of plastic, the lid 26 may be connected to the base 24 by a thin web of material which is sufficiently flexible to permit the lid 26 to be raised and lowered with respect to the base 24.

The lid 26 need not be rotatably connected to the base 24. For example, the lid 26 may be arranged to rest upon the base 24, such as by including a slot in a bottom surface thereof into which a top portion of each of the walls 36,38,40,42 may extend when the lid 26 is placed thereon. In such an arrangement, the lid 26 may be removed by lifting it off of the base 24.

Those of skill in the art will also appreciate the numerous means by which the lid 26 may be secured to the base 24. Instead of, or in addition to the latches 48, hooks, straps with hook and loop fastener material, or snaps or the like may be arranged to selectively engage the base 24 to maintain the lid 26 secured thereto. The lid 26 may include on its bottom surface a slot for accepting the base 24 or have an outwardly extending section for positioning within the walls 36,38,40,42, whereby the lid 26 may be press-fit into engagement with the base 24.

In one or more embodiments, a pad 54 is provided on a top surface 56 of the lid 26. The pad 54 may be of a variety of types, such as an element having durable outer polymer surface with a foam interior. In one or more embodiments, the top surface 56 of the lid 26 has a recessed or inset area 58 for accepting a portion of the pad 54. Preferably, the pad 54 covers a substantial portion of the top surface 56 of the lid 26. As illustrated, the pad 54 is generally rectangular, covering all but a narrow perimeter section of the lid 26. The pad 54 may have a variety of thicknesses and may be connected to the lid 26 in a variety of fashions. In one or more embodiments, the pad 54 may be selectively removable from the lid 26 for washing, replacement or the like.

Figure 3:
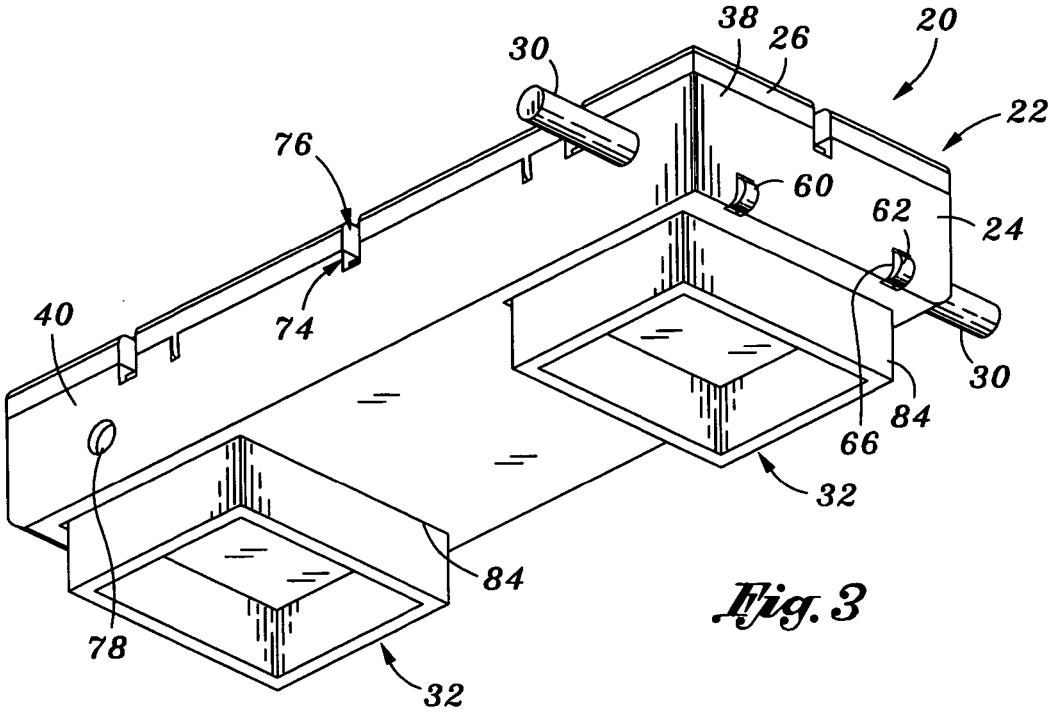
FIG. 3 is a perspective view of the exercise apparatus as in FIG. 1 with a lid thereof in an open position.

In one or more embodiments, means are provided for rollably supporting at least a portion of the platform 22. Referring to FIG. 3, in a preferred embodiment, the means comprises first and second wheels 60,62. As illustrated, the wheels 60,62 are positioned near the intersection of the first wall 36 and the bottom surface 34 of the base 24. In order to reduce the distance by which the wheels 60,62 extend from the base 24, and to provide a convenient mounting, each wheel 60,62 is inset into a slot 66 extending into the bottom surface 34 and first wall 36. The wheels 60,62 are spaced apart and located near the outer ends of the wall 36 for stability purposes.

In one or more embodiments, each wheel 60,62 is mounted on an axle (not shown) which is, in turn, mounted to the base 24. As will be appreciated, the wheels 60,62 may be mounted for rotation with respect to their axles and the axles securely connected to the base 24, the wheels 60,62 securely connected to their axles and the axles mounted for rotation with respect to the base 24, or the wheels 60,62 may be mounted for rotation with respect to their axles and the axles mounted for rotation with respect to the base 24. In any such arrangement, the wheels 60,62 are permitted to rotate with respect to the base 24, permitting a user to roll the platform 22 over a variety of surfaces.

It is preferred that the wheels 60,62 are mounted so that when the bottom 34 of the platform 22 is resting on a surface, the wheels 60,62 do not engage the surface or do not raise the platform 22 substantially off of the surface. This configuration aids in maintaining the platform 22 in a fixed position when in use. As illustrated, this configuration is achieved by positioning the wheels 60,62 substantially in the wall 36 and not the base. By having the wheels 60,62 protrude from the wall 36, a user may still roll the platform 22 by raising one end (at wall 38) upwardly so that the wheels 60,62 rotate into engagement with a surface.

The wheels 60,62 may be constructed from a wide variety of materials, such as plastic, rubber, steel or the like. The size of the wheels 60,62 may vary. Preferably, the wheels are relatively small so as to not increase the size or weight of the platform 22 unduly. In one or more embodiments, the wheels 60,62 have a diameter of approximately 1.25 inches and a width of approximately 0.75 inches.

In one or more embodiments, at least one handle is provided to aid a user in transporting the exercise device 20. As illustrated, two handles are provided. A first handle 68 is provided in the third wall 40 (i.e. the wall opposite the wall 42 to which the lid 26 is hinged). The first handle 68 comprises a generally oval cut-out or cut-away section of the third wall 40.

A second handle 70 is preferably provided opposite the side or wall with which the wheels 60,62 are associated. In the arrangement illustrated, since the wheels 60,62 are associated with the first wall 36, the second handle 70 is provided on the second, opposing wall 38. The second handle 70 comprises a generally oval cut-out or cut-away section of the second wall 38.

Those of skill in the art will appreciate that the handles 68,70 may take other forms. For example, each handle 68,70 may comprise an element which extends outwardly from the base 24. The handles 68,70 may be formed integrally with the base 24 or be connected thereto. Each handle 68,70 may comprise an element which is extendable from the base 24, such as in the case of a pop-out or flip-out handle. A handle may be provided on as few as one of the sides or walls of the base 24, or on all of them, and not just the two illustrated and described above.

The platform 22 includes at least one attachment point or mount for an exercise accessory. As illustrated, the platform 22 includes a plurality of such attachments points. Each attachment point preferably comprises a pin 72. Each pin 72 spans a slot 74 which extends downwardly from a top surface of a particular wall 36,38,40,42 of the base 24. As illustrated, one attachment point is provided approximately midway along the first wall 36 between the third and fourth walls 42,44. One attachment point is provided approximately midway along the second wall 38 between the third and fourth walls 42,44. Three attachment points are generally equidistantly provided along the third and fourth walls 42,44.

Each slot 74 generally comprises a rectangular cut-out of the respective wall 36,38,40,42, extending downwardly into the wall from a top surface thereof. A pin 72 extends or spans each slot 74 in a direction parallel to the wall 36,38,40,42. The pins 72 may comprise a wide variety of elements. In one or more embodiments, each pin 72 comprises a metal rod. The pins 72 may be constructed from wood, plastic or other durable and strong materials.

To facilitate easy access to the pins 72 and to permit use of a resistive or other element connected thereto (as described in more detail below), a slot 76 is provided in the lid 26 corresponding to each slot 74 in the walls of the base 24. As illustrated, each slot 76 preferably comprises a recessed or cut-away area of the lid 26.

The number and location of the mounts may vary from those illustrated. In addition, other mounts may be provided, such as mounts on the lid 26 or other portions of the base 24. The manner of connection of the resistive element(s) 28 may be accomplished with other means than pins 72, such as hooks, eyes and other elements.

To facilitate additional accessories, as described in more detail below, first and second passages 78,80 are provided through the base 24. As illustrated, the passages 78,80 are positioned in opposing walls of the base 24. Preferably, the passages 78,80 are aligned along a common axis and positioned in the third and fourth 40,42 walls. Each passage 78,80 comprises a generally circular bore provided through its respective wall 40,42.

The passages 78,80 may be located in other areas in the base 24. In addition, more than one set of passages may be provided.

In accordance with the present invention, the exercise apparatus 20 comprises one or more accessories in addition to the platform 22. Referring to FIG. 2, the exercise apparatus 20 comprises one or more risers 32. As illustrated, there are two risers 32. Each riser 32 comprises a generally square, box-shaped support. In one or more embodiments, each riser 32 is generally hollow (see FIG. 3), having a top surface 82 and a perimeter wall 84 extending downwardly therefrom. Preferably, the top surface 82 of each riser 32 is generally planar for accepting the bottom 34 of the platform 22.

Referring to FIG. 3, in one or more embodiments, the bottom of the bottom surface 34 of the base 24 has a pair of inset or recessed areas sized to accept the risers 32. In this fashion, when the platform 22 is placed on the risers 32 an interlocking effect is achieved and it is less likely that the base 24 will move off of the risers 32 (such as in a sliding motion). In one or more embodiments, the recessed areas are inset into the bottom surface 34 by approximately 0.5 inches.

Preferably, the risers 32 are sized (considering their height, width and length) so that they both may be conveniently stored in the hollow interior 44 of the platform 22 when the lid 26 is closed. In one or more embodiments, each riser 32 is about 4 inches high, and has a width of about 10.5 inches (in use parallel to walls 40,42) and a depth of about 8.5 inches (in use parallel to walls 36,38).

It is noted that a single riser 32 or multiple risers may be provided instead of the two risers 32 described and illustrated. For example, a single large riser 32 may be used. Several risers 32 may be arranged to "nest" within one another when stored, and be arranged to stack when in use. The risers 32 may have a variety of configurations other than square.

In one or more embodiments, a variety of other means may be used to selectively raise and lower the platform 22. Preferably, however, such means does not contribute to an increase in the size of the platform 22 when the means is not in use. In other words, as with the risers 32, it is preferred that the means fit within or not increase the size of the platform 22 as designed for its normal exercise use. The means may comprise one or more feet or legs which extend, fold or rotate out of the platform 22. The means may comprise a platform or box which is nearly the same size as the base 24 and which when placed upside-down therein (open size up) reduces the size of the interior 44 by only the width of the peripheral wall forming the box.

In one or more embodiments, the exercise apparatus 20 includes at least one hand/foot peg 30. Preferably, the exercise apparatus 20 includes two pegs 30. As illustrated, each peg 30 comprises a rod-shaped element. A first portion 86 of each peg 30 preferably has a smaller exterior dimension (in this case, diameter) than a second portion 88. The first portion 86 is sized to fit within one of the passages 80 formed in the platform 22. The increased size of the second portion 88 serves as a stop to prevent over-insertion of the peg 30 into its respective passage 78,80.

The pegs 30 may be constructed from a wide variety of materials such as wood or plastic. In one or more embodiments, each peg 30 is about 9 inches long, with the first portion 86 being about 3 inches long. In an embodiment where the platform 22 includes multiple passages, additional foot/hand pegs 30 may be provided.

Preferably, a sleeve 90 is provided in association with the pegs 30. As illustrated, the sleeve 90 is a tubular element having a hollow interior. The sleeve 90 has an outer diameter sized to permit insertion of the sleeve 90 into the passages 80. The sleeve 90 has a length such that it will span the interior 44 of the platform 22 from passage to passage 80. Preferably, each peg 30 is inserted both through the passage 80 and into the sleeve 90.

In one or more embodiments, a detent (not shown) may be formed near each end of the sleeve 90 for acceptance of a projection (not shown) provided on each peg 30. Such a projection preferably is small enough not to prevent insertion of the peg 30 into the sleeve 90, but is arranged to engage one of the detents, providing some locking effect and an indication to the user of the proper engagement of the peg 30 with the sleeve 90, and securing the peg 30 in place (such as during exercise) except against a high withdrawal force.

The foot/hand pegs 30 may be arranged in a wide variety of other fashions. For example, the pegs may comprise members which fold/swivel outwardly from the base 24. The pegs 30 also need not be round, especially the first portion 86. For example, the first portion 86 of each peg 30 may be triangular or square. In such event, the corresponding passage 78,80 is preferably also similarly shaped. Such a peg 30 may be used when it is desired to prevent the rotation of the peg with respect to the passage. A single elongate peg 30 may be provided and arranged to extend entirely through the base 24.

In one or more embodiments, the exercise apparatus 20 includes at least one resistive element 28. Preferably, the resistive element 28 comprises an elastic, rubber or similar element which may be stretched or extended, and when stretched or extended, generates a biasing force. The resistive element 28 may include multiple strands or bands associated with one another as well. Such elements are well known in the art of exercise equipment.

Preferably, a handle 92 is located at a first end of the resistive element 28. As illustrated, the handle 92 has a gripping portion 94 and a connecting portion 96, the connecting portion 96 connected to the elastic band or other element forming the resistive portion of the element 28.

Means are provided for attaching the resistive element 28 to the platform 22. In one or more embodiment, this means comprises a hook 98 positioned at the end of the resistive element 28 opposite the handle 92. The hook 98 is adapted to receive one of the pins 72 of the platform 22. In one embodiment, the hook 98 includes a hook portion 100 and a latch member 102. The hook portion 100 is generally "J"-shaped. The latch member 102 is attached at one end to a top portion of the hook portion 100. A second end of the latch member 102 is permitted to freely move with respect to the hook portion 100, but biased into a position such that the latch member 102, along with the hook portion 100, forms a generally closed element. In this arrangement, the latch member 102 may be deflected inwardly to permit passage of the hook 98 over the pin 72, but will generally not deflect the opposite direction, retaining the lock 98 securely connected to the pin 72.

In one or more embodiments, a similar hook 99 is provided at an opposing end of the restive element 28 for selective connection to the handle 96 and other accessories such as an exercise bar 104. Of course, the position of the resistive element 28 may be reversed, as the hooks 98,99 at either end of the resistive element 28 may be connected to either the platform 22 or an accessory.

As illustrated, the exercise bar 104 comprises an elongate rod or similar item. In one or more embodiments, the bar 104 has a central core 106 made of steel, plastic or a similar strong and durable material. The bar 104 includes a pad 108 comprising a coating or sleeve over all or a portion of the core 106. In one or more embodiments, a ring 110 or similar element for connection of one of the hooks 98,104 is located at each end of the bar. The bar 104 may have a variety of lengths and configurations. For example, the bar 104 need not be straight, but may include one or more bends as is known in "curl"-bars. Preferably, the bar 104 has a length which permits it to be stored within the interior 44 of the platform 22, such as slightly less than about 3 feet long.

One or more embodiments of the invention comprise a method of using the exercise apparatus 20 of the present invention. A user may store a variety of items in the interior 44 of the platform 22 for storage. These items include the "accessories" described above (resistive elements 28, pegs 30, risers 32, bar 104), and other items such as exercise clothing, towels and the like. These items may be securely stored by latching the latches 48, securing the lid 26 to the base 24 and enclosing them in the interior 44 of the platform 22.

When the lid 26 is closed, a user may conveniently transport the exercise apparatus 20. First, a user may roll the apparatus 20 over a surface. A user may pull the apparatus 20 by gripping the handle 70 at the end of the base 24 opposite the wheels 60,62 and rolling the apparatus 20 on the wheels 60,62.

A user may transport the exercise apparatus 20 by carrying it as well. The user may grip either handle 68,70 to lift and carry the apparatus 20.

When at a particular location, the user may use the exercise apparatus 20 in a variety of manners, as described in detail below. In general, the user may remove the accessories from the platform 22 for use therewith. The user unlatches the latches 48 to release the lid 26, and then rotates the lid to an open position to access the interior portion 44.

The user may insert each peg 30 into a respective one of the passages 78,80. The user presses the smaller first portion 86 of each peg 30 into its respective passage 78,80 and a portion of the sleeve 90. The peg 30 is securely inserted when the larger, second portion 88 of the peg 30 abuts the base 24.

A user may connect the resistive element(s) 28 to the platform 22. The user presses the hook 98 into engagement with one of the pins 72.

If the user desires to raise the level of the platform 22, the user may remove the risers 32 and place them under the platform 22. When the base 24 includes recessed areas therein, the base 24 is aligned with the risers 32 so as to engage the risers 32.

When exercising, it is desirable for the user to re-latch the lid 26 to the base 24. This prevents the lid 26 from opening during use of the apparatus 20.

Of course, when the user has completed exercising, the user may re-stow all of the accessories and other items in the interior 44 of the platform 22 for storage and/or transport.

One or more embodiments of the invention comprise a method of exercising using the exercise apparatus 20 of the present invention. First, a user may use the platform 22 as a step in a step exercise. In this type of exercise, the user steps up and down onto and off of the platform 22. Such exercises are well known.

In order to increase the difficulty of the exercise, the height of the platform 22 may be raised. A user may remove the risers 32 from the interior 44 of the platform 22 and place the platform 22 on the risers. This raises the top surface 56 of the lid 26 farther above the surrounding surfaces.

A user may perform a variety of exercises on the platform 22. For example, a user may rest their back upon the pad 54 on the platform 22 and perform sit-ups, crunches or similar exercises. A user may also rest their back on a surrounding surface and rest their feet/legs upon the raised platform 22 when performing similar exercises.

The user may perform a wide variety of exercises with one or more resistive elements 28, which generate an exercise biasing or resistive force when stretched. The resistive elements 28 may be connected to the platform 22 in a variety of positions and in a variety of combined configurations to accommodate most common exercises. Such exercises include shoulder presses (pressing the arms overhead while gripping the resistive elements), lateral raises (extending the arms from a down to horizontally extending position while gripping the resistive elements), leg lunges (lunging on an off the platform while gripping the resistive elements), calf extensions (raising and lowering the body at the toes while gripping the resistive elements), curls (curling the arms while gripping the resistive elements), tricep extensions (extending the arms while gripping the resistive elements), adduct and abduct leg exercises (extending a leg outwardly or across the other leg with the resistive element connected thereto).

A user may perform exercises with the resistive elements 28 coupled to each end of the bar 104 and the platform 22. Such exercises include squats and presses.

Of course, a variety of exercises may be performed with only one resistive element 28. For example, a user may perform a single arm bicep curl with just one resistive element 28 (as opposed to exercising both arms at the same time). In addition, in some exercises, multiple resistive elements 28 may be used together. For example, a user may perform a single arm bicep curl with two or more resistive elements.

In one or more embodiments, a user may engage in exercises including use of the foot/hand pegs 30. A user may perform a rowing exercise by sitting on the platform 22, placing their feet on the pegs 30 gripping and extending the resistive elements 28 in a rearward direction. A user may perform hamstring exercises by laying stomach-down on the platform 22, gripping the pegs 30 with the hands, hooking the resistive elements 28 to the feet and extending the elements 28 by flexing the leg at the knee. A user may perform leg kick-backs by placing one knee on the platform 22 and gripping the pegs 30 with the hands while retracting and extending the other leg.

The exercise apparatus 20 of the present invention has numerous advantages over the prior art. One advantage of the exercise apparatus 20 is that, despite its compactness and portability, the exercise apparatus 20 permits a user to engage in a wide variety of exercises.

It is noted that the arrangement and location of the mounts has a number of advantages. When a resistive element 28 is connected to a mount, it may be extended outwardly generally horizontally from the platform 22. On the other hand, the resistive element 28 may also be extended generally vertically above the lid 26. The aligned slot 76 in the lid 26 permits this orientation. At the same time, the resistive element 28 is securely connected to a portion of the sturdy and non-moving base 24.

The slots 76 in the lid 26 also provide an aligning and position maintaining function. When a resistive element 28 is connected to a mount and extends through the slot 76, the resistive element 28 is maintained in a fixed position and not permitted to move along the length (either along a side or end) platform 22. This is a benefit to the user, who when exercising can focus upon the exercise and not upon maintaining the equipment in fixed position to accomplish the exercise.

The location of the mounts along the walls 36,38,40,42 of the base 24 also permits maximum separation of the resistive elements 28 when connected thereto (such as when connected at opposing ends or sides of the platform 22) for exercises when a wide separation is desired, such as extended arm raises and the like. Thus, the platform 22 can be made smaller than when if the attachment points were provided in other configurations, such as on the lid 26.

The exercise apparatus 20 is particularly portable. It is relatively small, and includes handles and wheels for transport. Accessories and other equipment may be conveniently stored within the apparatus 20. The exercise apparatus 20 can be easily moved around for use and storage at home or in the office (such as when used in a room and stored in a closet). The exercise apparatus 20 can be placed in a car or transported as baggage on a plane/train when traveling.

The exercise apparatus 20 is compact. The exercise apparatus 20 does not take up a large amount of space, which is desirable for home and office use. The apparatus 20 may be stored in an upright (i.e. on end/wall 36/38), in which case its "footprint" is very small.

Additional aspects and other embodiments of the invention will now be described with reference to FIGS. 5-9.

As described, in one embodiment of the invention, resistive elements are configured to be used with the exercise apparatus. In the embodiment described above, the resistive elements 28 may be selective connected to one or more pins 72 or other connections.

Figure 5:
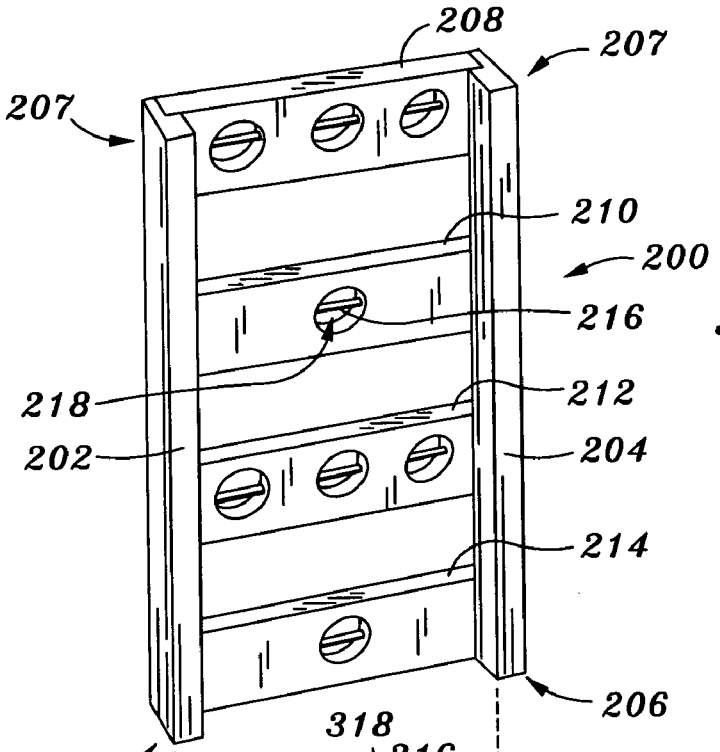
FIG. 5 illustrates in perspective view a ladder or tower in accordance with an embodiment of the invention.

In one embodiment, the exercise apparatus may include other points of attachment of resistive elements or other exercise equipment than the base. In one embodiment, as illustrated in FIG. 5, resistive elements or other exercise equipment may be connected to an exercise device support structure 200. In one embodiment the structure 200 resembles a tower or ladder, and that terminology is used for convenience only, it being understood that the structure does not need to be either a ladder or tower per se.

As illustrated, the tower 200 comprises a supporting structure and one or more points of attachment for exercise devices such as the resistive elements 28 described above. In the preferred embodiment, the tower 200 includes a first main support 202 and a second main support 204. As illustrated, the first and second main supports 202,204 are spaced from one another and extend generally parallel to one another. The first and second main supports 202,204 each have a first end 206 and a second end 207.

A plurality of cross-members 208,210,212,214 extend between and are supported by the first and second main supports 202,204. In one embodiment, each cross-member 208, 210,212,214 supports one or more pins 216 or other resistive element connection members. As illustrated, each pin 216 preferably spans an aperture 218. In a preferred embodiment, the pins 216 extend generally parallel to the cross-members 208,210,212,214 and generally perpendicular to the first and second main supports 202,204.

Figure 6:
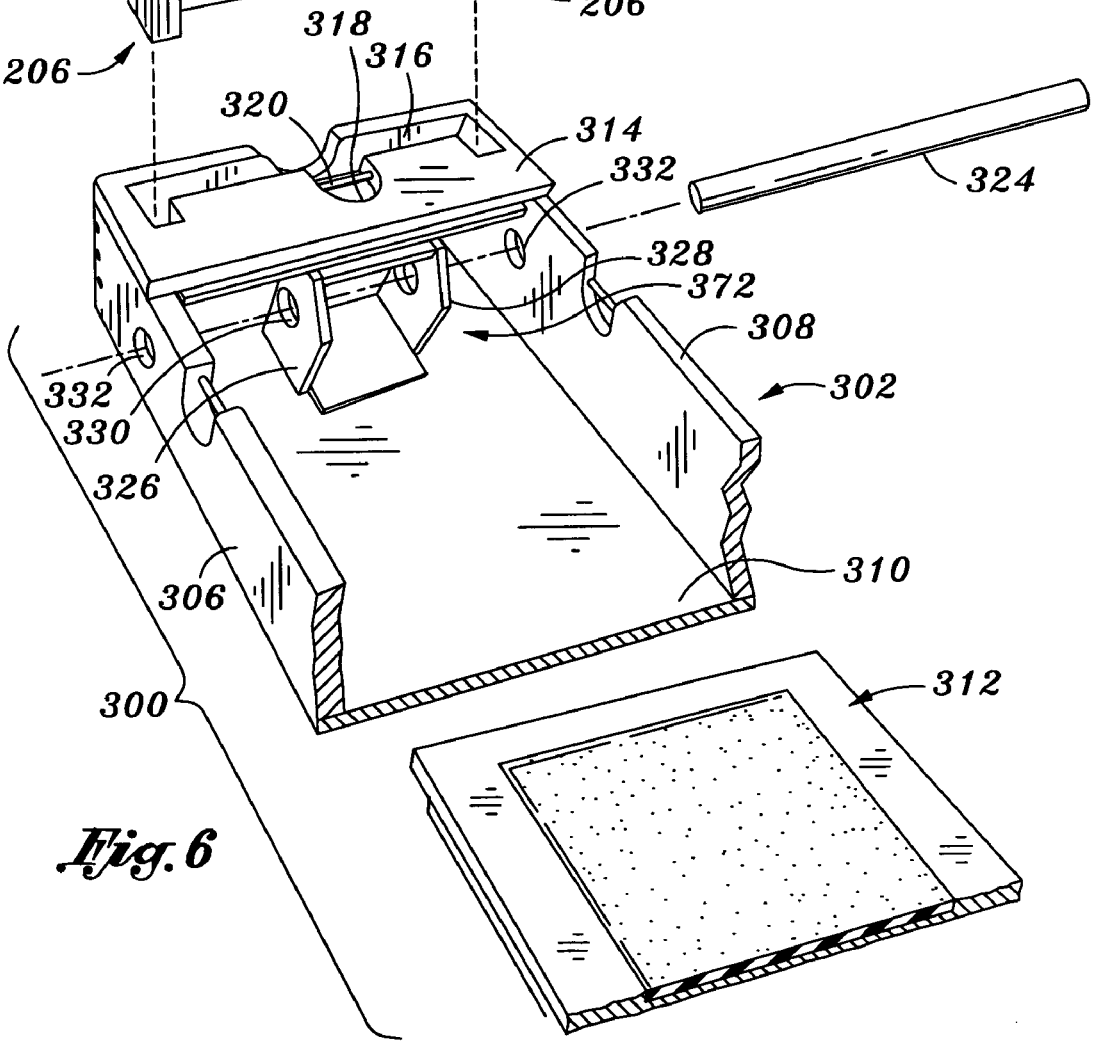
FIG. 6 illustrates in partial perspective exploded view another embodiment of an exercise platform of the invention configured to accept the tower or ladder illustrated in FIG. 5.

In one embodiment, the tower or ladder 200 is configured to be supported for use by an exercise apparatus. FIG. 6 illustrates one embodiment of an exercise platform 300 of the invention which is particularly adapted to use with the tower or ladder 200.

Preferably, the tower 200 is configured for use in a vertical position. As such, the exercise platform 300 is preferably configured to support the tower 200 in that position. In one embodiment, the platform 300 is similar to that described above, including a base 302 having four walls (only the two sides walls 306,308 are visible in FIG. 6) and a bottom surface 310, and a lid 312.

In one embodiment, the base 302 is configured to support the tower 200. As illustrated, an exercise device structure or tower support 314 is connected to the base 302. In one embodiment, the tower support 314 is located at the top of the base 302, and is positioned at one end thereof so as to be supported by one end wall and the opposing side walls 306, 308 of the base 302.

The tower support 314 has a generally "C"-shaped opening 316 therein. The opening 316 preferably has the same shape as the horizontal cross-sectional shape of the tower 200, and thus will accept therethrough the first and second main supports 202,204 and, in the embodiment illustrated, the lower-most cross-member 214.

As indicated, the tower 200 may have a variety of configurations. In one embodiment, the cross-members 208,210,212, 214 are spaced from one another along the first and second main supports 202,204. One of the cross-members 214 is located at the first ends 206 of the first and second main supports 202,204, and another of the cross-members 208 is located at the second ends 208 of the first and second main supports.

In this configuration, the lower-most cross-member 214 preferably extends through or partially through the opening 316 in the tower support 314 and into the base 302 when the tower 200 is connected to the platform 300. Preferably, the close spacing of the tower support 314 to the tower 200, as best illustrated in FIG. 7, aids in maintaining the tower 200 in a steady, upright or vertical position when it is connected to the platform 300.

Use of the tower 200 and other aspects of the tower 200 will now be described with reference to FIGS. 5-7. As illustrated in FIGS. 5 and 6, the tower or ladder 200 may preferably be selectively connected to the exercise platform 300 by passing the tower 200 through the opening 316 in the tower support 314.

Figure 7:
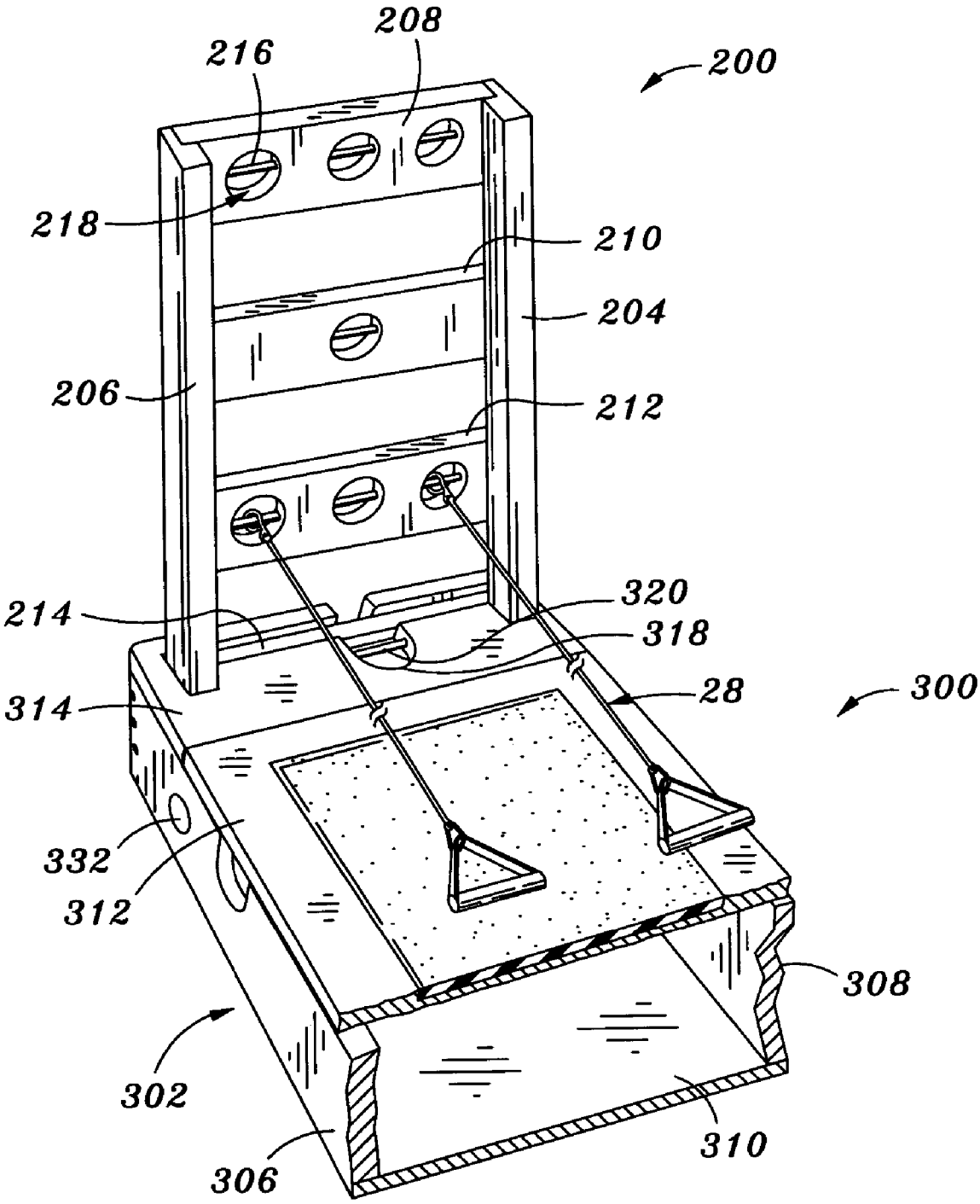
FIG. 7 illustrates in partial perspective view the exercise platform and tower/ladder illustrated in FIGS. 5 and 6 connected to one another and in a condition for use.

As illustrated in FIG. 7, once the tower 200 is connected to the platform 300, it is supported in a vertical position. As illustrated, the tower support 314 is located adjacent the first and second main supports 204,206 and the lower-most cross-member 214, effectively stabilizing the tower 200 from movement in the front-to-back or side-to-side directions. At the same time, however, the tower 200 can easily be removed from the platform 300 by simply lifting it upwardly.

Once supported by the platform 300, the tower 200 may be used to perform a variety of exercises. As illustrated, one or more resistive elements 28 may be connected to the tower 200. As illustrated, the resistive elements 28 may be connected to the pins 216. Advantageously, the user may choose the position or location of attachment of the resistive elements 28. For example, the user may attach the resistive elements 28 to one of the lower cross-members, such as to perform exercises where the elements are stretched in a horizontal and vertical direction, or may attach the resistive elements to one of the higher cross-members, such as to perform exercises where the elements are stretched in a substantially horizontal direction.

The resistive elements may be connect at the same or different locations. They may be connected so that they are used in the direction of the platform 300 (as illustrated), or in other directions. The resistive elements 28 or other equipment may be attached in other manners to the tower 200 aside from connection to the pins. In one embodiment, the tower 200 might include other points or types of connections, such as hooks or the like, including as mounted to the first and second main supports 202,204.

The tower 200 may have any height. In a preferred embodiment, however, the total length or height of the tower 200 is selected so that it does not exceed a length which allows it to be stored inside of the base 24. As illustrated in FIG. 6, the lid 312 of the platform 300 may be removed, allowing the tower 200 to be conveniently stored inside of the platform 300 when it is not in use.

The tower 200 may be constructed in a variety of manners. FIGS. 8A-8B and 9A-9B illustrate variations in the construction of the cross-members. It will be appreciated that any of the cross-members 208,210,212,214 may be constructed as illustrated in these figures.

Figure 8A:
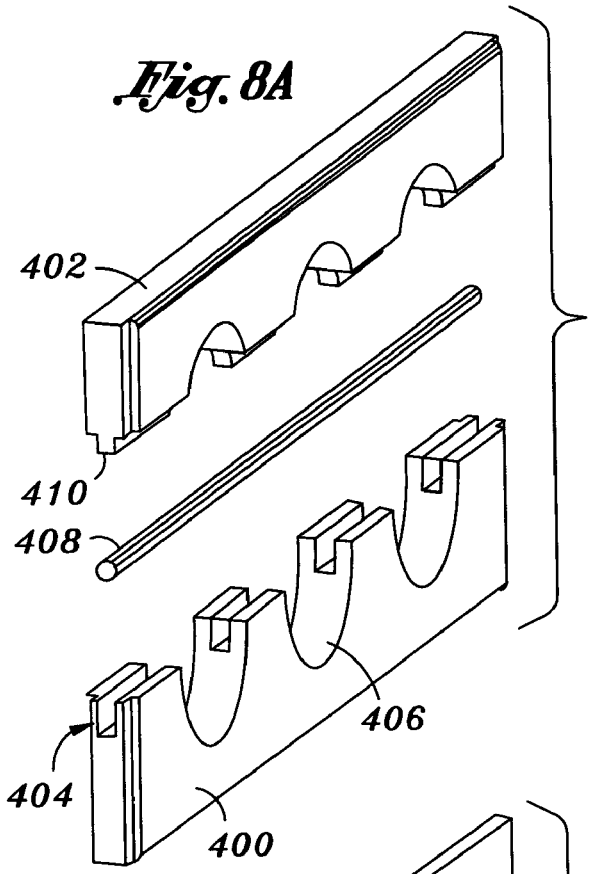
FIGS. 8A-8B illustrate a first exercise device connection of the tower/ladder illustrated in FIG. 5 in an exploded and assembled condition.
Figure 8B:
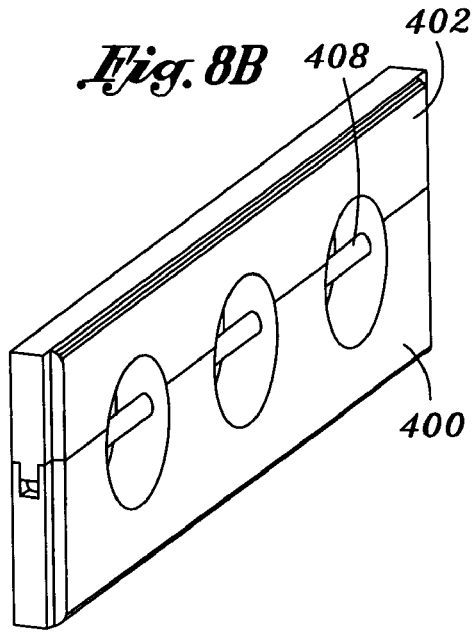

Referring to FIGS. 8A-8B, in one embodiment, a cross-member comprises a female member 400 and a male member 402. The female and male members 400,402 each define a portion of the one or more pin apertures, each thus having one or more arcuate cut-outs 406 therein (depending upon the total number of apertures to be formed). In one embodiment, the female member 400 defines more than one-half of each aperture.

The female member 400 defines a slot 404. The slot 404 intersects the cut-outs 406. The slot 404 accepts a rod 408. When positioned in the slot 404, the rod 408 extends across each cut-out 406, thus defining the "pins" associated with the cross-members.

The male member 402 defines a 410 which is configured to engage the slot 404 in the female member 400. When connected, as illustrated in FIG. 8B, the male and female members 400,402 cooperate to secure the rod 408 in position spanning the then formed apertures. The male and female member 400,402 may be maintained in connection in a variety of manners, such as with fasteners, adhesive, or by their connection to the first and second main supports of the tower, as illustrated in FIG. 5.

Figure 9A:
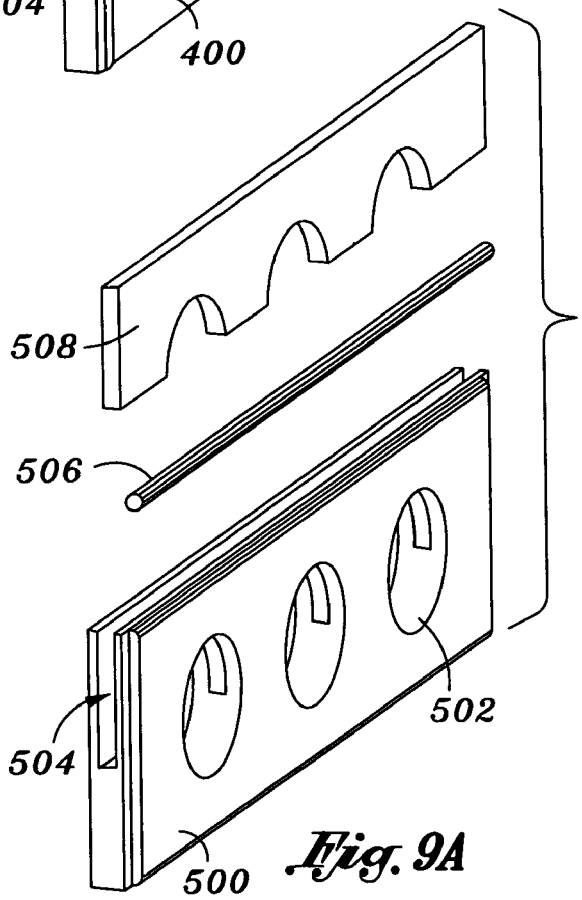
FIGS. 9A-9B illustrate a second exercise device connection of the tower/ladder illustrated in FIG. 5 in an exploded and assembled condition.
Figure 9B:
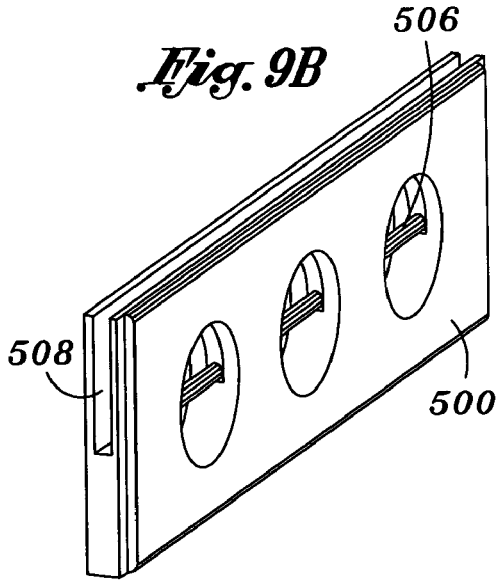

FIGS. 9A-9B illustrates another embodiment of a construction for the cross-members. As illustrated, a cross-member 500 defines one or more apertures 502. A slot 504 extends into the cross-member 500 and intersects the apertures 502.

The slot 504 accepts a rod 506, which when located in the cross-member, spans the apertures 502.

A key 508 is configured to be located in the slot 504 and secure the rod 506 into position. When assembled, as illustrated in FIG. 9B, the rod 506 is trapped between the key 508 and the cross-member 500. Once again, the key 508 may be connected to the cross-member 500 in a variety of manners, including with fasteners, adhesive, or by attachment of the cross-member to the tower, among others.

Of course, variations of the cross-member assemblies are contemplated. For example, instead of the cross-members including a single rod which defines the one or more pins of the cross-member, there might be a plurality of rods or individual pins. The cross-members might be constructed of additional elements. For example, there might be more than one key element.

In one embodiment, an elongate passage might be formed through the cross-member and the rod(s) inserted therethrough. The ends of that passage might be blocked with one or more keys in order to maintain the rod(s) in position.

Referring again to FIGS. 5 and 6, in one embodiment, the tower support 314 includes one or more resistive element attachment points. As illustrated, in one embodiment, the tower support 314 includes a cut-out 318 and a connecting pin 320. For ease of construction and use, in one embodiment, the cut-out 318 is integral with the tower opening 316. Of course, there may be additional or other points of attachment for exercise equipment.

As described above, in one embodiment, the base is configured to support one or more hand/foot pegs. FIGS. 5 and 6 illustrate a variation of the invention in which the platform 300 includes an internal support 322 for a hand/foot peg 324.

In one embodiment, the support 322 includes a pair of struts 326,328 which extend upwardly from the bottom 310 of the base 302, such as from a mount connected to the base 302. As illustrated, the struts 326,328 are spaced from one another and each define an aperture 330 through which the hand/foot peg 324 may pass. The struts 326,328 are positioned so that the apertures 330 are aligned with corresponding apertures 332 in the side walls 306,308 of the base 302.

As illustrated, a support may connect a top portion of the struts 326,328 in order to maintain them in rigid parallel position to one another. In this position, the apertures 330 therein remain aligned with the apertures 332 in the base 302, preventing flexing and the like which might bind the hand/foot peg 324.

Once again, the hand/foot peg 324 may be selectively connected to the platform 300 by passage through the apertures 330,332. The hand/foot peg 324 may also be removed, such as for storage inside the base 302.

As described above, the hand/foot peg 324 may have a variety of configurations, including comprising a single element or a sleeve with one or more pegs which attach to the sleeve.

It will be appreciated that the exercise device support structure illustrated in FIG. 5 may be used with other than an exercise platform of the invention, but may be mounted or connected to a variety of other devices for use. The ladder/tower might also be modified to include an integral base, feet or the like, so that it may be used alone. The structure might also be configured to connect to a door or other device, apart from the platform 300.

The tower may have a variety of other configurations. For example, it might have only one or more than two support elements, and as few as one or a plurality of member which support the exercise device attachment points. For example, the tower might have a single central support and cross-members supported thereby. The cross-members do not need to extend horizontally. For example, they may be angled or even extend vertically (i.e. parallel to the support members). In any event, the tower preferably provides a vertical range of attachment points for exercise devices/equipment.

As described, the exercise device support structure has numerous advantageous. Among other things, as used with the base, the tower/ladder permits a user to perform a much greater variety of exercises by allowing a much greater range of positions for connection of exercise devices, such as the resistive elements described. At the same time, the structure may be conveniently stored in the base when not in use, contributing to the compact nature of the exercise platform.

Means may be provided for securing the tower 200 to the platform 300. For example, when the tower 200 is in its upright position, one or more pins may be provided for passage through aligned holes in the base 302 and tower 200, preventing upward movement of the tower 200, such as during exercising.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. An exercise apparatus comprising:

an exercise platform comprising a base having upwardly extending walls on the periphery thereof to define an interior space;

a tower having a pair of spaced vertically extending supports, at least two cross-members extending between and supported by said vertically extending supports; and a plurality of connection members mounted onto said cross-members wherein the connection members are adapted to couple to an exercise device, said platform further comprises a tower mount having an opening configured to accept at least a portion of said tower to retain said tower in a generally vertical position during use and said tower is sized to fit entirely within said base when said tower is not in use.

2. The exercise apparatus in accordance with claim 1 wherein each cross-member has at least one aperture formed therethrough and a pin spanning said aperture, said pin defining one of said connection members.

3. The exercise apparatus in accordance with claim 1 wherein said said tower mount spans at least a portion of a top of said base.

4. The exercise apparatus in accordance with claim 3 wherein said tower mount is located at one end of said base.

5. The exercise apparatus in accordance with claim 3 further includes a lid cooperating with said tower mount to cover said top of said base and define a generally enclosed space in said base.

6. An exercise apparatus comprising:

an exercise platform comprising a base, an exercise structure mount supported by said base, said exercise structure mount and a lid, when connected side by side to said base, cooperates with said base to define a generally enclosed interior space of said platform, said exercise platform including at least one connection member to which one or more exercise devices can be attached; and an exercise structure comprising a pair of spaced elongated supports, at least one cross-member extending between and supported by said spaced supports and at least one connection member disposed on said at least one cross-member wherein said exercise structure is configured to be insertably connected selectively to said exercise structure mount so as to support said exercise structure in a generally vertical position and said exercise structure is sized to fit entirely within said enclosed interior space of said exercise platform when said exercise structure is not in use.

7. The exercise apparatus in accordance with claim 6 wherein said exercise structure mount has an opening therein configured to accept said exercise structure in said generally vertical position.

8. The exercise apparatus in accordance with claim 6 wherein said exercise structure comprises a plurality of cross-members, at least one of which along with a portion of said pair of supports engage said opening of said exercise structure mount.

* * * * *